US005970642A

United States Patent [19]

Martin

[11] Patent Number: 5,970,642

[45] Date of Patent: Oct. 26, 1999

[54] ERGONOMIC ADJUSTABLE GUN STOCK

[76] Inventor: Billy B. Martin, 3545 Omeara Dr., Houston, Tex. 77025

[21] Appl. No.: 09/015,718

[22] Filed: Jan. 29, 1998

[51] Int. Cl.[6] ..... F41C 23/06; F41C 23/14

[52] U.S. Cl. ..... 42/73; 42/74; 42/75.02

[58] Field of Search ..... 42/71.01, 73, 74, 42/75.02, 75.03

[56] References Cited

U.S. PATENT DOCUMENTS

| | | | |
|---|---|---|---|
| 2,901,854 | 9/1959 | Ivy | 42/71.01 |
| 2,952,934 | 9/1960 | Yovanovitch | 42/71.01 |
| 3,830,003 | 8/1974 | Clerke | 42/75.03 |
| 4,312,146 | 1/1982 | Koon, Jr. | 42/75.03 |
| 4,503,633 | 3/1985 | Davis | 42/71.01 |
| 5,711,102 | 1/1998 | Plaster et al. | 42/73 |

FOREIGN PATENT DOCUMENTS

| | | | |
|---|---|---|---|
| 63761 | 8/1892 | Germany | 42/73 |
| 184651 | 5/1970 | U.S.S.R. | 42/73 |

OTHER PUBLICATIONS

Dunlap; American Rifleman "Thoughts on Free–Rifles"; Apr., 1954; pp. 36–39; 42/71.01.

Kleinkaliberbuchsen; Mar. 30, 1973; pp. 7,10,11; 42/73.

*Primary Examiner*—Stephen M. Johnson

*Attorney, Agent, or Firm*—Kenneth A. Roddy

[57] ABSTRACT

An ergonomic adjustable gun stock having an elongate forearm portion with a longitudinal concave receiver channel in its upper surface for receiving the barrel of a gun, a butt portion extending rearwardly from the forearm portion, a vertically adjustable cheek piece, a longitudinally adjustable and removable auxilary hand gripping element on the underside of the butt portion, and an adjustable recoil butt pad assembly mounted on the rear end of the butt portion. The forearm and butt portions are generally rectangular polygonal configurations having a subtantially flat bottom surface and substantially flat opposed sides. The butt portion has a rounded top surface substantially parallel with its flat bottom surface. A thumb receiving aperture extends transversely through the butt portion near its forward end and defines a contiguous generally vertical handgrip portion adjoined to the forearm portion and a horizontal lower portion which also has a substantially flat bottom surface. The cheek piece is an inverted generally U-shaped member having a rounded top surface and contiguous laterally spaced parallel sides. The butt portion has a cheek piece receiving recess sized and shaped to slidably receive the cheek piece in a lowermost position, such that the outer periphery of the cheek piece is generally flush with the outer periphery of the butt portion in its lowermost position.

20 Claims, 3 Drawing Sheets

ERGONOMIC ADJUSTABLE GUN STOCK

BACKGROUND OF THE INVENTION

1. Field of the Invention

This invention relates generally to gun stocks, and more particularly to an ergonomic adjustable gun stock for rifles that has a polygonal forearm portion, a polygonal butt portion, a thumb receiving aperture and handgrip portion, a vertically adjustable cheek piece, a longitudinally adjustable and removable hand-stop on the underside of the butt portion, and an adjustable recoil butt pad assembly mounted on the rear end of the butt portion.

2. Brief Description of the Prior Art

Conventional gun stocks for rifles have a forearm portion, a butt portion, a handgrip portion, a comb or cheek piece mounted on the upper portion of the butt portion, and a recoil butt plate or butt pad mounted on the rear end of the butt portion.

The conventional forearm portion is rounded on the bottom and sides and the rounded bottom extends rearward and angularly downwardly from its front end and adjoins a pistol grip type handgrip portion which extends rearwardly and downwardly from the forearm portion. The conventional butt portion extends rearwardly from the handgrip portion and has rounded rounded bottom and top surfaces that diverge angularly outward along their length. The conventional recoil butt plate or butt pad is removably secured to the rear end of the butt portion with screws.

A problem with the rounded bottom and sides of the conventional forearm portion is that the rifle will tend to roll when supported on a support surface. Because the rounded bottom of the conventional forearm portion extends rearward and angularly downwardly from its front end, should the shooter slightly move the stock forward or rearward relative to the support surface, the inclination angle of the rifle barrel will change, and place the trajectory off-target. Thus, the shooter must use muscular tension to prevent the gun from rolling and prevent forward or rearward movement relative to the support surface.

A problem with the rearwardly and angularly downward extending pistol grip type handgrip portion of the conventional gun stock is that the wrist of the shooter must be angled relative to the forearm to grip the handgrip and pull the trigger. This angled wrist position produces in weaker squeezing action when pulling the trigger, muscular fatigue in the hand, fingers and wrist, and may result in wrist injury caused by the recoil action.

A problem with the rearward diverging rounded top and bottom surfaces of the conventional butt portion is that the bottom surface cannot be suitably supported on a flat surface since any slight forward or rearward movement will change the inclination angle of the rifle barrel and place the trajectory off-target. Also, there is no means on the butt portion which can be gripped with the shooters hand that is not holding the handgrip to facilitate maneuvering the rear portion of the stock to carry out various shooting tasks and allow the shooter to assume various holding stances and shooting positions.

Another problem with the angularly inclined top surface of the conventional butt portion is that it is fixed relative to the butt plate. In order to aim the rifle, the shooter places the butt plate against his or her shoulder and rests his or her cheek on the angular top surface of the butt plate. Since top surface extends angularly upward toward the butt plate at a fixed angle, the butt portion on which shooter rests his or her cheek may not comfortably fit or accomodate the shoulder, head and neck of shooters of different size. Thus, the shooter must often use the muscles of the head, neck and shoulder to proper position their cheek on the butt portion.

A problem with the conventional recoil butt plate or butt pad is that it is removably secured to the rear end of the butt portion with screws and must be completely removed and replaced with a different size plate or pad to properly fit the arm length of a particular shooter or in situations where a shooter may put on or remove a heavy jacket.

The present invention is distinguished over the prior art in general by an ergonomic adjustable gun stock that has an elongate forearm portion with a longitudinal concave receiver channel in its upper surface for receiving the barrel of a gun, a butt portion extending rearwardly from the forearm portion, a vertically adjustable cheek piece, a longitudinally adjustable and removable auxilary hand gripping element on the underside of the butt portion, and an adjustable recoil butt pad assembly mounted on the rear end of the butt portion. The forearm and butt portions are generally rectangular polygonal configurations having a subtantially flat bottom surface and substantially flat opposed sides. The butt portion has a rounded top surface substantially parallel with its flat bottom surface. A thumb receiving aperture extends transversely through the butt portion near its forward end and defines a contiguous generally vertical handgrip portion adjoined to the forearm portion and a horizontal lower portion which also has a substantially flat bottom surface. The cheek piece is an inverted generally Ushaped member having a rounded top surface and contiguous laterally spaced parallel sides. The butt portion has a cheek piece receiving recess sized and shaped to slidably receive the cheek piece in a lowermost position, such that the outer periphery of the cheek piece is generally flush with the outer periphery of the butt portion in its lowermost position.

SUMMARY OF THE INVENTION

It is therefore an object of the present invention to provide an ergonomic adjustable gun stock for firearms which will significantly improve a shooter's marksmanship.

It is another object of this invention to provide an ergonomic adjustable gun stock for firearms which will significantly reduce muscle tension in a shooter's head, neck, shoulders, wrists, and fingers.

Another object of this invention is to provide an ergonomic adjustable gun stock for firearms which can be easily and guickly adjusted to custom fit shooters of different size without disassembly.

Another object of this invention is to provide an ergonomic adjustable gun stock for firearms that has a vertical handgrip portion and large thumb receiving aperture which produces an improved grip and better leverage when pulling the trigger and reduces the likelihood of injury to the shooter's thumb and wrist.

Another object of this invention is to provide an ergonomic adjustable gun stock for firearms which has an auxilary gripping surface on the bottom of butt portion which can used to firmly press the butt portion into the shooter's shoulder cavity to steady the rifle with less muscle tension, and to maneuver the rear portion of the stock when aiming and allow various holding stances and shooting positions.

Another object of this invention is to provide an ergonomic adjustable gun stock for firearms which has flat support surfaces that prevent the gun from rolling or canting and causes the recoil action to be channeled more properly in a linear axis parallel to the shooter's line of sight.

A further object of this invention is to provide an ergonomic adjustable gun stock for firearms that has a butt portion with a horizontal top surface and a vertically adjustable cheek piece having a horizontal top surface which will more properly channel the recoil action in a linear axis parallel to the shooter's line of sight.

A still further object of this invention is to provide an ergonomic adjustable gun stock for firearms which is simple in construction and inexpensive to manufacture.

Other objects of the invention will become apparent from time to time throughout the specification and claims as hereinafter related.

The above noted objects and other objects of the invention are accomplished by an ergonomic adjustable gun stock that has an elongate forearm portion with a longitudinal concave receiver channel in its upper surface for receiving the barrel of a gun, a butt portion extending rearwardly from the forearm portion, a vertically adjustable cheek piece, a longitudinally adjustable and removable auxilary hand gripping element on the underside of the butt portion, and an adjustable recoil butt pad assembly mounted on the rear end of the butt portion. The forearm and butt portions are generally rectangular polygonal configurations having a subtantially flat bottom surface and substantially flat opposed sides. The butt portion has a rounded top surface substantially parallel with its flat bottom surface. A thumb receiving aperture extends transversely through the butt portion near its forward end and defines a contiguous generally vertical handgrip portion adjoined to the forearm portion and a horizontal lower portion which also has a substantially flat bottom surface. The cheek piece is an inverted generally U-shaped member having a rounded top surface and contiguous laterally spaced parallel sides. The butt portion has a cheek piece receiving recess sized and shaped to slidably receive the cheek piece in a lowermost position, such that the outer periphery of the cheek piece is generally flush with the outer periphery of the butt portion in its lowermost position.

DESCRIPTION OF THE PREFERRED EMBODIMENT

Figure 1:
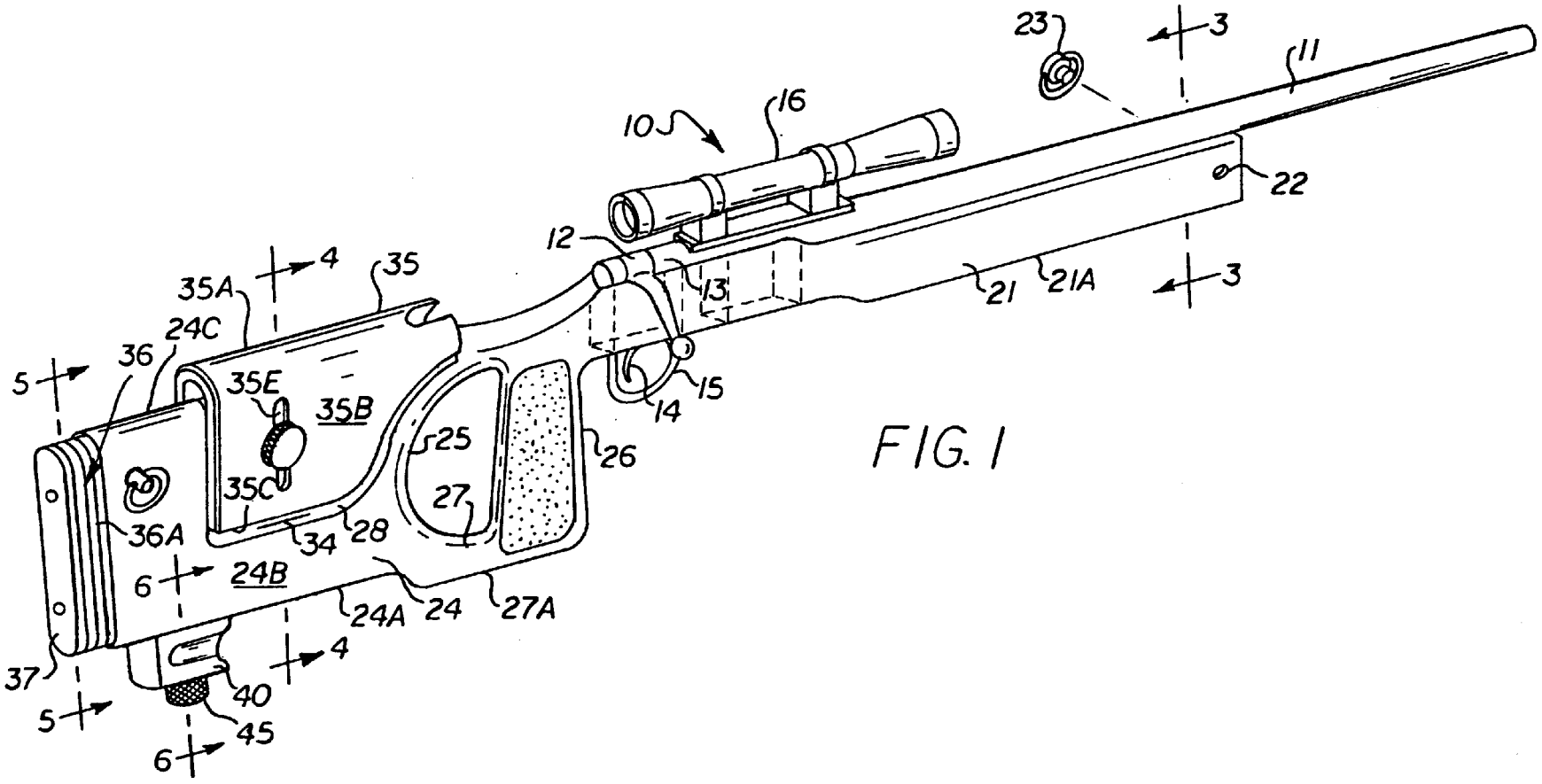
FIG. 1 is a perspective view of a rifle equipped with the ergonomic adjustable gun stock in accordance with the present invention.

Referring to the drawings by numerals of reference, there is shown in FIG. 1, a standard rifle assembly 10 secured to the ergonomic adjustable gun stock 20 in accordance with the present invention. The rifle hardware includes a barrel 11, a bolt 12 at the rearward end of the barrel, an action 13, a trigger 14, a trigger guard 15, and may include a scope 16.

Figure 2:
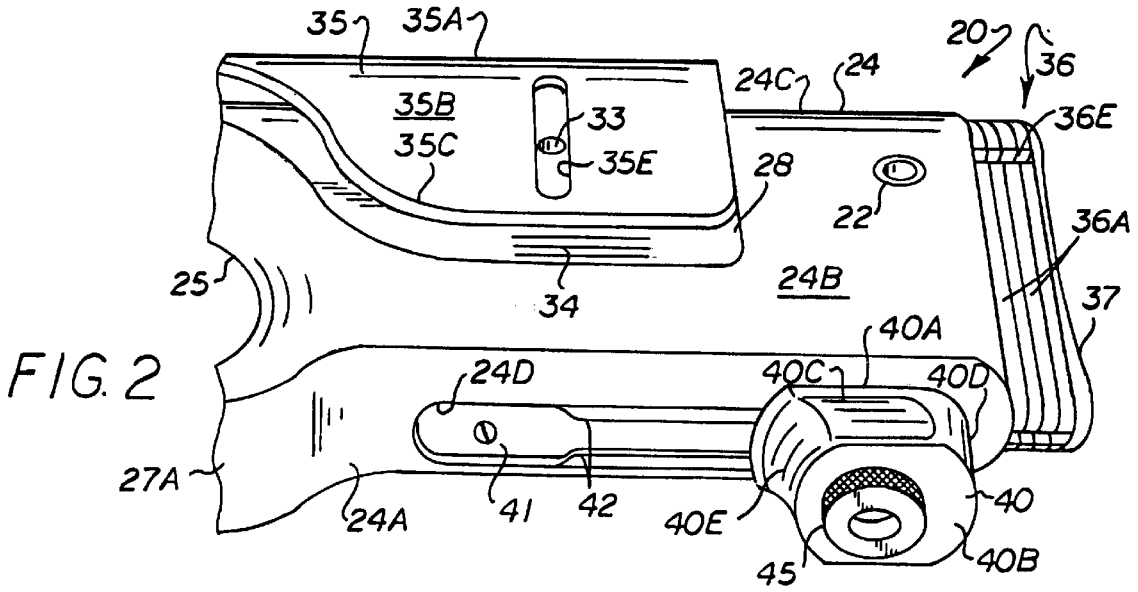
FIG. 2 is a perspective view taken from the underside of the butt portion of the gun stock showing the adjustable check piece and adjustable hand-stop.

As best seen in FIGS. 1 and 2, the ergonomic adjustable gun stock 20 includes a forearm portion 21, a butt portion 24, a D-shaped thumb receiving aperture 25, and a handgrip portion 26. An adjustable cheek piece 35 is mounted on the upper portion of the butt portion 24, an adjustable and removable hand stop 40 is mounted on the underside of the butt portion, and a recoil butt pad assembly 36 is mounted on the rear end of the butt portion.

In a preferred embodiment, the gun stock 20 is formed of fiberglass, but may be formed of any suitable lightweight material such as plastics, wood, aluminum, or composite materials.

Figure 3:
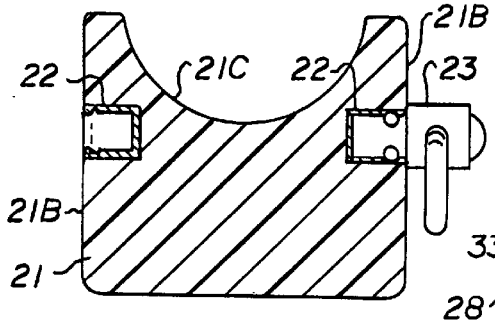
FIG. 3 is a transverse cross section through the forearm portion of the gun stock taken along line 3—3 of FIG. 1 showing the polygonal forearm configuration and concave receiver channel, with the rifle barrel removed.

As shown in cross section in FIG. 3, the forearm portion 21 is a generally rectangular polygonal configuration having a flat bottom surface 21A, opposed flat sides 21B and a longitudinally extending concave receiver channel 21C formed in its top surface for receiving the barrel of the rifle. In a preferred embodiment, the channel 21C is sized to provide ¼" clearance around the rifle barrel. The forearm portion 21 is also provided with vertical and horizontal slots and mounting holes through its rear portion for receiving and mounting the bolt action 13, trigger 14 and trigger guard 15 mechanisms of the rifle. The rifle mounting slots and holes are conventional in the art and therefore not shown in detail. A conventional quick release insert 22 is flush mounted in both opposed side walls 21B of the forearm portion 21 near its forward end for removably receiving a quick release shoulder sling swivel D-ring 23 on either side.

Figure 4:
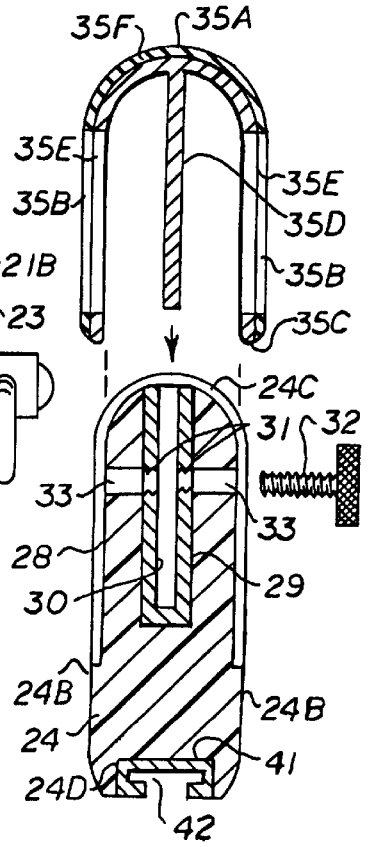
FIG. 4 is a transverse cross section through the butt portion of the gun stock taken along line 4—4 of FIG. 1 showing the check piece adjustment mechanism.

As shown in FIGS. 1, 2, and 4, the butt portion 24 of the gun stock 20 is a generally rectangular polygonal configuration having a flat bottom surface 24A, opposed flat sides 24B and a longitudinally extending convex rounded top portion 24C. A large generally D-shaped thumb receiving aperture 25 extends transversely through the butt portion 24 near its forward end defining a contiguous vertical handgrip portion 26 and horizontal lower portion 27. The handgrip portion 26 extends vertically downward from the underside of the forearm portion 21 and tapers slightly outwardly near its lower portion and adjoining horizontal lower portion 27. The outer surface of the handgrip portion 26 may be provided with a rough or checkering surface texture.

The vertical axis of the handgrip portion 26 is disposed substantially 90° relative to the longitudinal axis of the forearm portion 21. The inner facing surfaces of the D-shaped thumb receiving aperture 25 and horizontal lower portion 27 are smoothly rounded and contoured. The horizontal lower portion 27 beneath the thumb receiving aperture 25 has a flat bottom surface 27A which is vertically spaced a short distance below the flat bottom surface 24A of the butt portion 24.

As best seen in FIGS. 2 and 4, the upper portion of the opposed flat sides 24B and convex rounded top portion 24C of the butt portion 24 are recessed a distance rearwardly from the D-shaped thumb receiving aperture 25 to define a cheek piece receiving recess 28. A generally rectangular metal insert 29 is secured vertically in the butt portion 24 and has a rectangular slot 30 extending downwardly from its top end and a threaded hole 31 through each side for threadedly receiving the shank of a thumb screw 32 from either side. Holes 33 extend transversely through the butt portion 24 in axial alignment with the holes 31. A series of horizontal vertically spaced indexing grooves 34 are formed in the opposed sides of the cheek piece receiving recess 28.

The cheek piece 35 is thin inverted U-shaped or saddle-shaped member having a rounded top surface 35A and contiguous laterally spaced parallel sides 35B with flat bottom edges 35C and a central rectangular tang 35D extending downwardly from the underside of the rounded top surface. A vertical slot 35E extends through each side of the cheek piece 35. The cheek piece tang 35D is slidably received in the rectangular slot 30 and the shank of the thumb screw 32 is installed through the vertical slot 35E, hole 33, and threadedly engaged the hole 31 in one side of the insert 29. The cheek piece 35 is secured by turning the thumb screw 32 to engage its shank on the tang 35D. Thus, the cheek piece 35 is vertically adjustable and may be secured at a desired height relative to the butt portion 24. The bottom edges 35C of the cheek piece 35 may be visually aligned with the indexing grooves 34 to facilitate quick and precise adjustment and positioning of the cheek piece to to fit various individual shooters, proper aiming, and accomodate various shooting positions.

In a preferred embodiment the cheek piece 35 is formed of metal with its outer facing surfaces covered with a layer of soft resilient material 35F. The thickness of the cheek piece 35 and the depth of the cheek piece receiving recess 28 are approximately the same such that when the cheek piece is in the lowermost position it will be generally flush with the. outer surface of the butt portion 24.

A conventional quick release insert 22 is flush mounted in both opposed side walls 24B of the butt portion 24 near its rearward end for removably receiving a quick release shoulder sling swivel D-ring 23 on either side.

Figure 5:
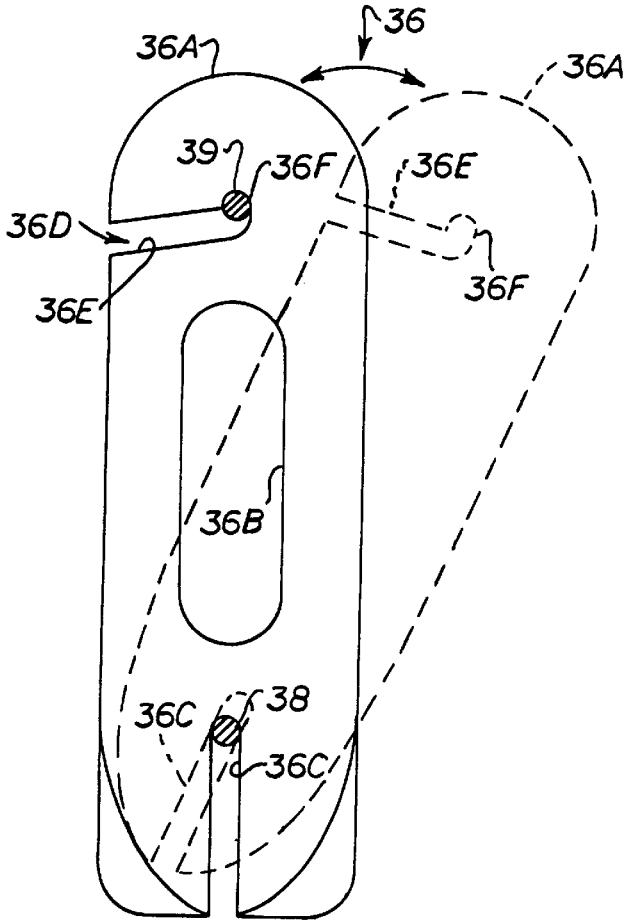
FIG. 5 is a transverse cross section through the butt portion of the gun stock taken along line 5—5 of FIG. 1 showing a butt pad spacer being inserted into the recoil butt pad.

Referring now to FIGS. 2 and 5, the recoil butt pad assembly 36 mounted on the rear end of the butt portion 24 is comprised of a series of flat rigid spacer elements 36A and a butt plate 37 at the rearward end. Each spacer element 36A is a flat generally oval-shaped configuration having a predetermined thickness, for example ¼" or ½". The spacer elements 36A each have an elongate central aperture 36B and a vertical slot 36C extending upwardly from its bottom end. Each spacer element has a J-shaped slot 36D with an elongate portion 36E extending laterally inward and angularly upward from one side and terminating in a short vertical portion 36F. The recoil butt plate 37 is formed of a resilient pad secured to a rigid base plate and has a pair of mounting holes that extend through the base plate and larger diameter holes that extend through the resilient pad. The construction of the butt plate 37 and its mounting holes are conventional in the art and therefore not shown in detail.

The spacer elements 36A and butt plate 37 are secured in stacked relation to the rear end of the butt portion 24 by a pair of elongate vertically spaced allen head screws 38 and 39. The shanks of the allen head screws 38 and 39 are slidably received through the holes in the base plate and threadedly engaged in threaded holes in the rear end of the butt portion 24 and the heads of the allen head screws are received in the larger diameter holes in the resilient pad and rotatably engaged on the base plate of the butt plate 37 in a conventional manner.

As best seen in FIG. 5, spacer elements 36A may be added to, or removed from, the stack between the rear end of the butt portion 24 and the base plate of the butt plate 37 without removing the butt plate or the allen head mounting screws 38 and 39. To add a spacer 36A, the allen head screws 38 and 39 are backed out a short distance and the butt plate 37 is retracted. The vertical slot 36C in the lower portion of the spacer to be added is slid onto the shank of the lower allen head screw 38 and its upper portion is pivoted about the lower shank such that the lateral elongate portion 36E of the J-shaped slot 36D is received on the shank of the upper allen head screw 39 and then the insert is pushed downwardly to engage the short vertical portion 36F of the slot 36D on the shank of the upper allen head screw 39. The allen head screws 38 and 39 are then tightened.

To remove a spacer 36A, the procedure is reversed. The alien head screws 38 and 39 are backed out a short distance to loosen the stack. The spacer to be removed is pushed upwardly to disengage the short vertical portion 36F of the J-shaped slot 36D from the shank of the upper allen head screw 39 and its upper portion is pivoted about the lower shank 38 such that the lateral elongate portion 36E of the J-shaped slot is disengaged from the shank of the upper allen head screw 39. The spacer can then be grasped and pulled outwardly until the vertical slot 36C in its lower end is disengaged from the shank of the lower allen head screw 38. The allen head screws 38 and 39 are then tightened.

Thus, the spacers 36A allow the distance of the recoil butt plate 37 relative to the handgrip 26 and cheek piece 35 to be quickly and precisely adjusted to properly fit the arm length of various individual shooters, or to accomodate various shooting positions, or in situations where a shooter may put on or remove a heavy jacket.

Figure 6:
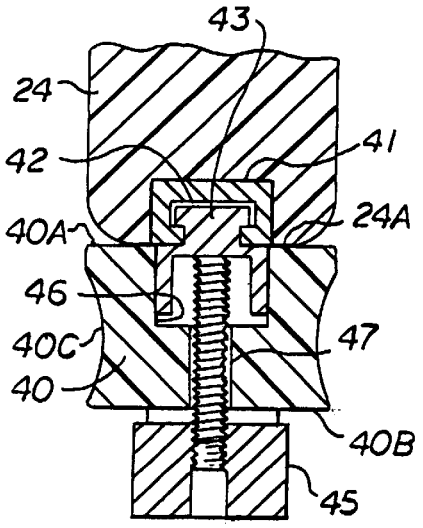
FIG. 6 is a transverse cross section through the butt portion of the gun stock taken along line 6—6 of FIG. 1 showing the hand-stop adjustment mechanism.

Referring now to FIGS. 1, 2, and 6, the adjustable and removable hand stop 40 is mounted on the underside of the butt portion 24. The hand stop 40 has a flat top end 40A, a flat bottom end 40B, opposed concave lateral sides 40C, an outwardly rounded rear side 40D, and a curved concave front side 40E. The concave lateral sides 40C are sized and shaped for gripping by the thumb and forefinger of the shooter's hand that is not holding the handgrip and the curved concave front side 40E is sized and shaped to receive the portion of the shooter's hand between the thumb and forefinger. The hand stop 40 is used to facilitate steadying the rifle and maneuvering the rear portion of the stock.

An elongate slide channel 41 is flush mounted in a longitudinal slot 24D formed in the flat bottom surface 24A of the butt portion 24. The slide channel 41 has a longitudinal slot 42 which is T-shaped in transverse cross section. A rectangular locking block 43 having a T-shaped top end end is slidably mounted in the T-shaped slot 42 and has a threaded shank 44 extending from its bottom end for receiving an internally threaded thumb nut 45.

The hand stop 40 has a square recess 46 extending inwardly from its top end 40A and a central bore 47 extending inwardly from its bottom end. The lower portion of the locking block 43 is slidably received in the square recess 46 and the shank 44 of the locking block extends slidably through the central bore 47 and a short distance beyond the flat bottom end 40B of the hand stop 40. The depth of the recess 46 is greater than the lower portion of the locking block 43. The thumb nut 45 is theadedly mounted on the outer end of the shank 44 and, when rotated in one direction, will engage the bottom end 40B of the hand stop 40 and draw the hand stop toward the locking block 43, thereby firmly gripping the T-shaped slot 42 between the top end 40A of the hand stop and the T-shaped portion of the locking block to lock the hand stop in place and prevent sliding movement.

The position of the hand stop 40 can be longitudinally adjusted by loosening the thumb nut 45 and sliding the hand stop along the bottom of the butt portion 24 and then locking it in the desired position by tightening the thumb nut to place the hand stop in the desired position for steadying the rifle and maneuvering the rear portion of the stock to accomodate various holding stances and shooting positions.

As seen in FIG. 2, at the forward end of the slide channel 41, the opposed inward facing sides of the T-shaped slot 42 are spaced further apart than the width of the locking block 43 so that the hand stop 40 can be easily and quicky removed by loosening the thumb nut 45 and sliding the hand stop forward until the locking block enters the wider portion of the slot 42 and clears the sides of the slot.

Having described the details of the ergonomic adjustable gun stock, the advantages obtained during its usage will now be described.

The polygonal flat bottom and sides of the forearm portion 21 prevents the rifle from rolling and canting when supported on a support surface. Because the flat bottom 21A of the forearm portion 21 extends horizontally rearward from its front end, the shooter may move the stock forward or rearward relative to the support surface and not significantly affect the inclination angle of the rifle barrel, and can easily maintain the trajectory on-target. The flat sides may also be supported against a vertical surface. Thus, the shooter expends less muscular tension to prevent the gun from rolling or canting and in preventing forward or rearward movement relative to the support surface.

The vertical handgrip portion 26 and large thumb receiving aperture 25 allows the handgrip portion to be gripped with the wrist generally aligned with the shooter's forearm with a portion of the shooter's palm to closer to the longitudinal axis of the stock and the major portion of their thumb on one side of the longitudinal axis and their forearm on the other side of the axis. This feature produces better leverage when pulling the trigger, reduces muscular fatigue in the hand, fingers and wrist, and reduces the likelihood of wrist and thumb injury caused by the recoil action. It also takes out the Y axis component of the trigger finger movement, which facilitates a more proper position without disturbance of the sight picture.

The flat bottom surface 27A beneath the thumb receiving aperture 25 and flat bottom surface 24A of the butt portion 24 allows the rear portion of the stock to be supported on a convenient support surface in various shooting positions and prevents the rifle from rolling when supported on the support surface and allows the shooter to move the stock forward or rearward relative to the support surface and not significantly affect the inclination angle of the rifle barrel. It also causes the rifle to recoil in a straight line to the rear.

The longitudinally adjustable and removable hand stop 40 provides an auxilary gripping surface on the bottom of butt portion 24 which can be gripped by the hand that is not holding the handgrip to firmly press the butt portion into the shoulder cavity to steady the rifle with less muscle tension, and to maneuver the rear portion of the stock when aiming and allow various holding stances and shooting positions.

The saddle shaped vertically adjustable cheek piece 35 may be secured at a desired height relative to the butt portion 24 and the soft resilient outer layer 35F on the cheek piece provides a soft surface on which the user may rest his or her cheek, absorbs some of the impact during the recoil action and reduces the likelihood of bruising the shooter's cheek. The indexing grooves 34 on the cheek piece receiving recess 28 allows the cheek piece 35 to be quickly and precisely positioned to carry out various shooting tasks and to accomodate and fit the shoulder, head, and neck of shooters of different size. Thus, the shooter will experience less muscular tension of the head, neck and shoulder muscles when resting their cheek on the cheek piece. The reduced tension in these muscles allows more blood to flow to the brain and keeps it oxygenated and allows the shooter to properly focus on the scope reticle and target. Because the cheek piece 35 and top of the butt portion 24 are horizontal, rather than angular, the recoil action is channeled more properly in a linear axis parallel to the shooter's line of sight.

The removable spacers 36A of the recoil butt pad assembly 36 allow the distance of the recoil butt plate 37 relative to the handgrip 26 and cheek piece 35 to be quickly and precisely adjusted to properly fit the arm length of an individual shooter, or in situations where a shooter may put on or remove a heavy jacket. When the recoil butt plate is properly positioned relative to the handgrip and cheek piece and to accomodate the shooters arm length, the shooter will experience less muscular tension of the head, neck, shoulder, and arm muscles and there is less likelihood of bruising the shooter's shoulder and cheek during the recoil action, and the resultant torsional recoil will be channeled more properly in a linear axis parallel to the shooter's line of sight.

While this invention has been described fully and completely with special emphasis upon a preferred embodiment, it should be understood that within the scope of the appended claims the invention may be practiced otherwise than as specifically described herein.

I claim:

1. An ergonomic adjustable gun stock, comprising:

an elongate forearm portion having a longitudinal axis with a longitudinal concave receiver channel in an upper surface for receiving a barrel of a gun and slots for receiving a trigger and trigger guard mechanism of the gun;

a butt portion extending rearwardly from said forearm portion terminating in a rear end;

recoil absorbing means mounted on said butt portion rear end;

an aperture extending transversely through said butt portion near a forward end thereof for receiving the thumb of a shooter;

a contiguous handgrip portion formed at a forward side of said aperture adjoined at an upper end to said forearm portion and at a lower end to said butt portion for receiving the fingers of said shooter; and an adjustable cheek piece with locking means slidably mounted on opposed sides of said butt portion for vertical sliding movement relative thereto, said cheek piece capable of being locked at selected vertical distances relative to said butt portion and said forearm portion.

2. The gun stock according to claim 1, wherein said handgrip portion has a central axis which is generally perpendicular to said forearm portion longitudinal axis.

3. The gun stock according to claim 1, wherein said forearm portion is a generally rectangular polygonal configuration having a subtantially flat bottom surface and substantially flat opposed sides.

4. The gun stock according to claim 1, wherein said butt portion is a generally rectangular polygonal configuration having a substantially flat bottom surface, substantially flat opposed sides, and a top surface substantially parallel with said flat bottom surface.

5. The gun stock according to claim 1, further comprising a horizontal lower portion beneath said thumb receiving aperture contiguous with said handgrip portion and said butt portion and having a substantially flat bottom surface.

6. The gun stock according to claim 1, further comprising:

an adjustable and removable hand gripping element with locking means slidably mounted in a bottom surface of said butt portion configured to be gripped by the hand of said shooter that is not gripping said handgrip portion;

said hand gripping element capable of being locked at selected positions along a longitudinal portion of said butt portion bottom surface.

7. The gun stock according to claim 1, wherein said recoil absorbing means includes a resilient base plate capable of being adjustably positioned forward or rearward at selected distances relative to said butt portion.

8. The gun stock according to claim 1, further comprising;

a first set of quick release insert elements flush mounted in laterally opposed sides of said forearm portion near a forward end thereof for removably receiving a quick release shoulder sling swivel ring on either of said laterally opposed sides of said forearm portion; and a second set of quick release insert elements flush mounted in laterally opposed sides of said butt portion near a rearward end thereof for removably receiving a quick release shoulder sling swivel ring on either of said laterally opposed sides of said butt portion.

9. The gun stock according to claim 1, further comprising:

visual indexing means on said butt portion disposed adjacent to said cheek piece for visually indicating relative positions of said cheek piece.

10. The gun stock according to claim 1, wherein said butt portion top surface is outwardly rounded; said cheek piece is an inverted generally U-shaped member having a rounded top surface and contiguous laterally spaced parallel sides; and a portion of said butt portion opposed sides and said outwardly rounded top surface are recessed to define a cheek piece receiving recess sized and shaped to slidably receive said cheek piece in a lowermost position, such that said cheek piece will be generally flush with said butt portion in said lowermost position.

11. A gun having an ergonomic adjustable gun stock, comprising:

a gun stock having an elongate forearm portion with a longitudinal axis and a longitudinal concave receiver channel in an upper surface thereof;

a gun barrel mounted in said receiver channel and having a trigger and trigger guard mechanism disposed beneath a bottom surface of said forearm portion;

a butt portion extending rearwardly from said forearm portion terminating in a rear end and having a forward end adjacent to said trigger and trigger guard;

recoil absorbing means mounted on said butt portion rear end;

an aperture extending transversely through said butt portion near a forward end thereof for receiving the thumb of a shooter;

a contiguous handgrip portion formed at a forward side of said aperture adjoined at an upper end to said forearm portion and at a lower end to said butt portion for receiving the fingers of said shooter; and an adjustable cheek piece with locking means slidably mounted on opposed sides of said butt portion for vertical sliding movement relative thereto, said cheek piece capable of being locked at selected vertical distances relative to said butt portion and said forearm portion.

12. The gun according to claim 11, wherein said handgrip portion has a central axis which is generally perpendicular to said forearm portion longitudinal axis.

13. The gun according to claim 11, wherein said forearm portion is a generally rectangular polygonal configuration having a subtantially flat bottom surface and substantially flat opposed sides.

14. The gun according to claim 11, wherein said butt portion is a generally rectangular polygonal configuration having a substantially flat bottom surface, substantially flat opposed sides, and a top surface substantially parallel with said flat bottom surface.

15. The gun according to claim 11, further comprising a horizontal lower portion beneath said thumb receiving aperture contiguous with said handgrip portion and said butt portion and having a substantially flat bottom surface.

16. The gun according to claim 11, further comprising:

an adjustable and removable hand gripping element with locking means slidably mounted in a bottom surface of said butt portion configured to be gripped by the hand of said shooter that is not gripping said handgrip portion;

said hand gripping element capable of being locked at selected positions along a longitudinal portion of said butt portion bottom surface.

17. The gun according to claim 11, wherein said recoil absorbing means includes a resilient base plate capable of being adjustably positioned forward or rearward at selected distances relative to said butt portion.

18. The gun according to claim 11, further comprising;

a first set of quick release insert elements flush mounted in laterally opposed sides of said forearm portion near a forward end thereof for removably receiving a quick release shoulder sling swivel ring on either of said laterally opposed sides of said forearm portion; and a second set of quick release insert elements flush mounted in laterally opposed sides of said butt portion near a rearward end thereof for removably receiving a quick release shoulder sling swivel ring on either of said laterally opposed sides of said butt portion.

19. The gun according to claim 11, further comprising:

visual indexing means on said butt portion disposed adjacent to said cheek piece for visually indicating relative positions of said cheek piece.

20. The gun according to claim 11, wherein said butt portion top surface is outwardly rounded; said cheek piece is an inverted generally U-shaped member having a rounded top surface and contiguous laterally spaced parallel sides; and a portion of said butt portion opposed sides and said outwardly rounded top surface are recessed to define a cheek piece receiving recess sized and shaped to slidably receive said cheek piece in a lowermost position, such that said cheek piece will be generally flush with said butt portion in said lowermost position.

* * * * *